US005558571A

United States Patent [19]

Toyoshima et al.

[11] Patent Number: 5,558,571

[45] Date of Patent: Sep. 24, 1996

[54] PORTABLE GRINDER

[75] Inventors: Takeshi Toyoshima, Ibaraki-ken; Yo Kawakami, Mito; Hiroyasu Ishikawa, Katsuta; Takao Abe, Hitachi; Satsuo Sato, Katsuta; Nobuhiro Noto, Katsuta; Tadahiro Kaneko, Katsuta; Takayoshi Kaneta, Ibaraki-ken; Juurou Kobayahsi; Osamu Kawanobe, both of Katsuta, all of Japan

[73] Assignee: Hitachi Koki Company Limited, Tokyo, Japan

[21] Appl. No.: 262,334

[22] Filed: Jun. 17, 1994

[30] Foreign Application Priority Data

Sep. 3, 1993 [JP] Japan ..... 5-220278

[51] Int. Cl.[6] ..... B24B 23/00

[52] U.S. Cl. ..... 451/358; 451/344; 451/352; 451/359

[58] Field of Search ..... 451/344, 352, 451/358, 359

[56] References Cited

U.S. PATENT DOCUMENTS

| | | | |
|---|---|---|---|
| 4,735,020 | 4/1988 | Schulz et al. | 451/344 |
| 5,020,280 | 1/1991 | O'Reilly | 451/359 |
| 5,042,207 | 8/1991 | Kirn | 451/358 |
| 5,163,250 | 11/1992 | Weber | 451/352 |
| 5,177,905 | 1/1993 | Takahashi et al. | 451/358 |

FOREIGN PATENT DOCUMENTS

| | | | |
|---|---|---|---|
| 1936720 | 2/1971 | Germany . | |
| 2156770 | 5/1973 | Germany . | |
| 2732271 | 1/1979 | Germany . | |
| 4122320A1 | 1/1979 | Germany | 451/344 |
| 4343662 | 11/1992 | Japan . | |

OTHER PUBLICATIONS

Makita Catalog 1976.

*Primary Examiner*—D. S. Meislin
*Assistant Examiner*—George Nguyen
*Attorney, Agent, or Firm*—Pollock, Vande Sande & Priddy

[57] ABSTRACT

A grinder has a grinding member. The grinder includes a rotatable spindle having an engagement portion. A first flange engages the engagement portion of the spindle. The first flange and the engagement portion of the spindle define a given play therebetween in a direction of rotation. The grinding member is held between the first flange and a second flange. A lubricant solid material is provided between the first flange and the engagement portion of the spindle.

11 Claims, 9 Drawing Sheets

PORTABLE GRINDER

BACKGROUND OF THE INVENTION

1. Field of the Invention

This invention relates to a portable grinder such as an electric portable disk grinder.

2. Description Of the Prior Art

Electric portable disk grinders have a grinding wheel detachably mounted on a rotatable spindle or shaft. Specifically, a threaded flange in mesh with a threaded portion of the spindle is used to fix the grinding wheel to the spindle. When the threaded flange is rotated by a wrench or spanner in a forward direction, the grinding wheel is fastened to the spindle. As the threaded flange is reversed by the wrench, the grinding wheel is released.

During a grinding process, when the grinding wheel is subjected to an excessively great load, the threaded flange fastens the grinding wheel to the spindle by a greater torque. In such a case, to detach the grinding wheel from the spindle after the grinding process has been completed, a greater return torque needs to be applied to the wrench.

Japanese published unexamined patent application 4-343662 discloses an electrically-powered tool in which a rotatable blade is detachably mounted on a spindle by a fastening device. The fastening device is designed to provide secure attachment of the blade to the spindle but enable easy detachment of the blade therefrom.

SUMMARY OF THE INVENTION

It is an object of this invention to provide an improved portable grinder.

A first aspect of this invention provides a grinder having a grinding member which comprises a rotatable spindle having an engagement portion; a first flange engaging the engagement portion of the spindle, wherein the first flange and the engagement portion of the spindle define a given play therebetween in a direction of rotation; a second flange; means for enabling the grinding member to be held between the first flange and the second flange; and a lubricant solid material provided between the first flange and the engagement portion of the spindle.

It is preferable that the lubricant solid material comprises a ring member.

It is preferable that the ring member comprises at least first and second pieces, the first piece including a lubricant solid member, the second piece including an abrasive-resistant member.

The grinder may further comprise means for preventing separation of the first flange from the spindle.

The grinder may further comprise means for sealing the ring member.

It is preferable that the lubricant solid material comprises a non-lubricant ring member and a lubricant applied to the ring member.

A second aspect of this invention provides a grinder having a grinding member which comprises a rotatable spindle having an engagement portion; a first flange engaging the engagement portion of the spindle, wherein the first flange and the engagement portion of the spindle define a given play therebetween in a direction of rotation; a second flange; and means for enabling the grinding member to be held between the first flange and the second flange; wherein the first flange comprises a main body, a sub member, and means for bonding the sub member and the main body together, the sub member engaging the engagement portion of the spindle.

The grinder may further comprise means, provided on a surface of the first flange which contacts the grinding member, for increasing a coefficient of friction between the first flange and the grinding member.

It is preferable that the increasing means comprises a recess in the surface of the first flange, and the bonding means comprises a rivet at least partially disposed in the recess.

It is preferable that the bonding means comprises a projection on the main body, a corresponding portion of the sub member which engages the projection, and means for connecting a part of the projection to the sub member.

The grinder may further comprise a ring plate provided between the first flange and the engagement portion of the spindle, the ring plate being made of a plastic.

It is preferable that the sub member has a bent surface for engaging the engagement portion of the spindle.

It is preferable that a portion of the main body limits a deformation of an outer part of the ring member to suppress an increase in an outside diameter of the ring member.

DESCRIPTION OF THE PREFERRED EMBODIMENTS

First Embodiment

Figure 1:
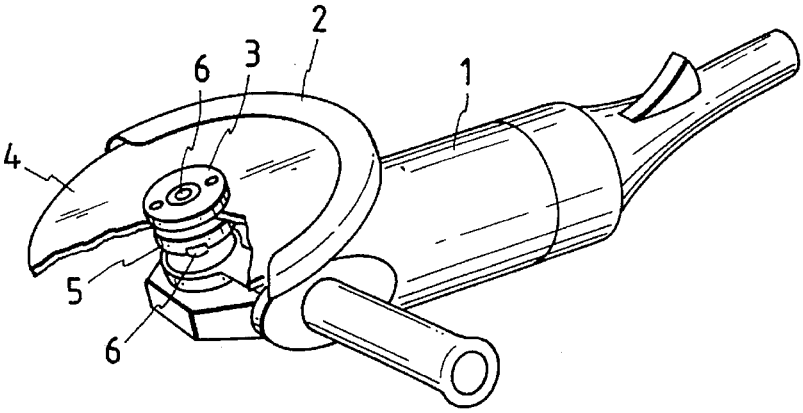
FIG. 1 is a partially cutaway view in perspective of an electric portable disk grinder according to a first embodiment of this invention.

With reference to FIG. 1, an electric portable disk grinder has a body 1 provided with a rotatable spindle or shaft 6. An electric motor disposed in the body 1 drives the spindle 6. Circular flanges 3 and 5 are mounted on the spindle 6. A grinding wheel or disk 4 is held between the flanges 3 and 5, being mounted on the spindle 6. A cover 2 supported on the body 1 conceals a part of the circumference of the grinding wheel 4.

Figure 2:
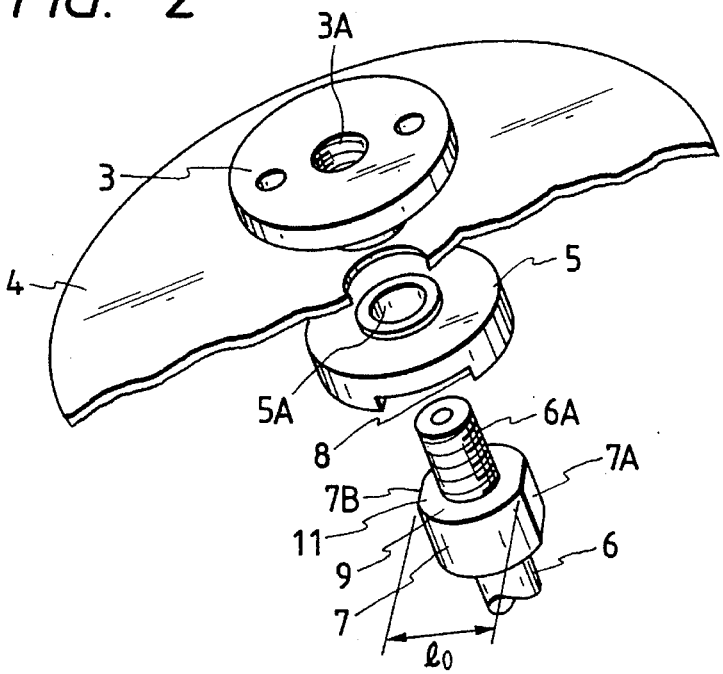
FIG. 2 is an exploded view of parts of the portable disk grinder in FIG. 1.
Figure 3:
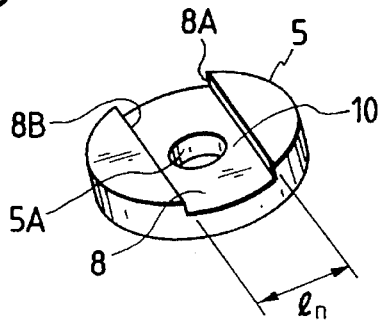
FIG. 3 is a perspective view of a fixed-side flange in the portable disk grinder in FIG. 1.
Figure 4:
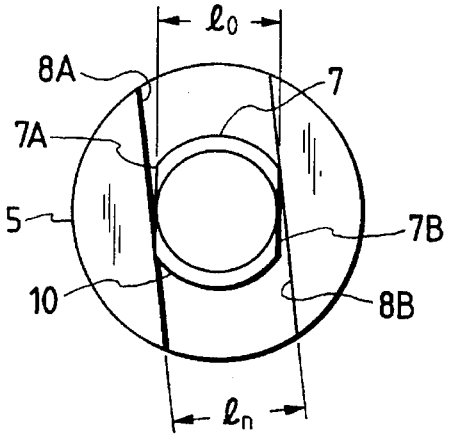
FIG. 4 is a plan view of the fixed-side flange and an engagement portion of a spindle in the portable disk grinder in FIG. 1.

As shown in FIG. 2, the spindle 6 has a threaded upper end 6A, and a boss or an engagement portion 7 extending below the threaded upper end 6A. The flange 5 has a central bore 5A through which the upper end 6A of the spindle 6 extends. The engagement portion 7 of the spindle 6 has a pair of parallel flat surfaces 7A and 7B equidistant from the axis of the spindle 6. The flat surfaces 7A and 7B have a predetermined axial length. The flat surfaces 7A and 7B are separated from each other by a predetermined distance lo. A lower surface of the flange 5 has a groove 8. As shown in FIG. 3, the groove 8 has a pair of parallel flat sides 8A and 8B defined by the walls of the flange 5. The flat sides 8A and 8B of the groove 8 are equidistant from the center of the flange 5. The flat sides 8A and 8B have a predetermined axial dimension corresponding to the depth of the groove 8B. The flat sides 8A and 8B are separated from each other by a predetermined distance ln. When the grinding wheel 4 is mounted on the spindle 6 in position, an upper end of the engagement portion 7 of the spindle 6 extends into the groove 8 of the flange 5 so that the engagement portion 7 engages the flange 5. Specifically, as shown in FIG. 4, the flat surfaces 7A and 7B of the engagement portion 7 of the spindle 6 engage the walls of the flange 5 which define the flat sides 8A and 8B of the groove 8. In this case, an upper end surface 9 of the engagement portion 7 of the spindle 6 engages or substantially contacts a surface 10 of the flange 5 which defines a bottom of the groove 8. The surfaces 9 and 10 are referred to as contacting surfaces.

When the grinding wheel 4 is mounted on the spindle 6 in position, a part of the upper end 6A of the spindle 6 emerges upward from the flange 5. The upper end 6A of the spindle 6 extends through a central bore of the grinding wheel 4. The flange 3 has a central bore 3A defined by threaded walls. The threaded upper end 6A of the spindle 6 extends into the threaded bore 3A of the flange 3 so that the spindle end 6A meshes with the threaded portion of the flange 3. When the grinding wheel 4 is mounted on the spindle 6 in position, the grinding wheel 4 is firmly held between the flanges 3 and 5. Since the flange 5 remains fixed to the spindle 6A during operation of the disk grinder, the flange 5 is referred to as a fixed-side flange. Since the flange 3 is rotated relative to the spindle 6 by a wrench or spanner during attachment and detachment of the grinding wheel 4 to and from the spindle 6, the flange 3 is referred to as a movable-side flange.

Attachment of the grinding wheel 4 to the spindle 6 is executed as follows. Under conditions where the movable-side flange 3 is separated from the spindle 6 but the fixed-side flange 5 is supported on the engagement portion 7 of the spindle 6, the grinding wheel 4 is placed on the fixed-side flange 5 while the upper end 6A of the spindle 6 is passed through the central bore of the grinding wheel 4. Then, the movable-side flange 3 is brought into contact with the upper end 6A of the spindle 6 before being rotated relative to the spindle 6 in a forward direction by the wrench. As the movable-side flange 3 is rotated in the forward direction, the movable-side flange 3 moves toward the fixed-side flange 5 and the upper end 6A of the spindle 6 advances into the bore 3A of the movable-side flange 3. Therefore, as the movable-side flange 3 is rotated in the forward direction, the movable-side flange 3 presses the grinding wheel 4 against the fixed-side flange 5 so that the movable-side flange 3 and the fixed-side flange 5 firmly hold the grinding wheel 4 therebetween.

Detachment of the grinding wheel 4 from the spindle 6 is executed as follows. The movable-side flange 3 is rotated relative to the spindle 6 in a reverse direction opposite to the forward direction. Generally, rotation of the movable-side flange 3 is enabled by using the wrench. As the movable-side flange 3 is rotated in the reverse direction, the movable-side flange 3 moves away from the fixed-side flange 5 and the upper end 6A of the spindle 6 moves out of the bore 3A of the movable-side flange 3. Therefore, as the movable-side flange 3 is rotated in the reverse direction, the grinding wheel 4 is released. The movable-side flange 3 is separated from the upper end 6A of the spindle 6. Then, the grinding wheel 4 is separated from the engagement portion 7 and the upper end 6A of the spindle 6.

The distance (interval) ln between the flat sides 8A and 8B of the groove 8 in the fixed-side flange 5 is greater than the distance (interval) lo between the flat surfaces 7A and 7B of the engagement portion 7 of the spindle 6. Accordingly, there is a given play between the fixed-side flange 5 and the engagement portion 7 of the spindle 6 in the rotational direction. The dimension of the play corresponds to the difference between the intervals ln and lo. As the interval ln increases, the play in the rotational direction also increases.

To rotate the movable-side flange 3 in the forward direction for fastening the grinding wheel 4, it is necessary to apply at least a certain torque to the movable-side flange 3 by the wrench. This torque is now referred to as a forward torque. To reverse the movable-side flange 3 for releasing the grinding wheel 4, it is necessary to apply at least a certain torque to the movable-side flange 3 by the wrench. This torque is now referred to as a return torque "tr". A return angle θr is now defined as an angle by which the movable-side flange 3 is rotated and returned from its normal fastening position.

Figure 5:
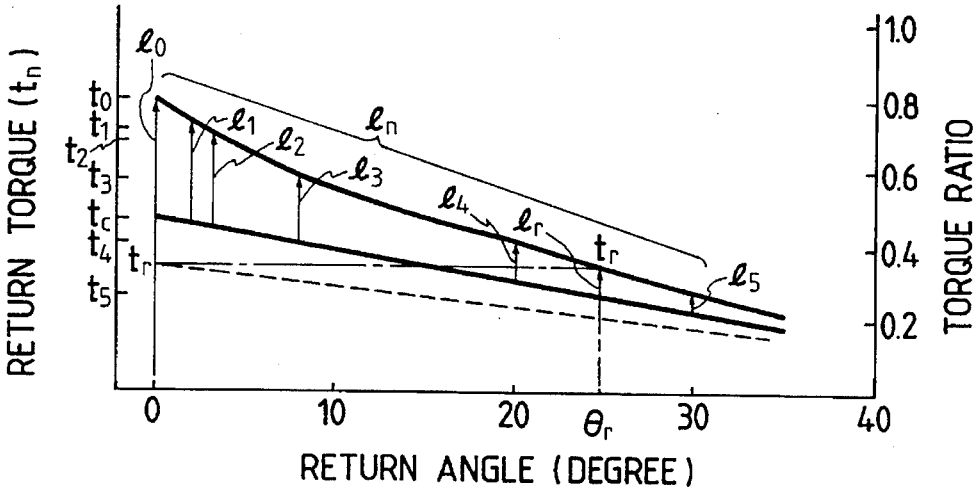
FIG. 5 is a diagram of the relation among a return torque, a return angle, and a torque ratio in the portable disk grinder in FIG. 1.

FIG. 5 shows the relation between the return torque "tr" and the return angle θr which occurs under conditions where the interval ln is changed among different values l0, l1, l2, l3, l4, and l5 and the area of contact between the fixed-side flange 5 and the engagement portion 7 of the spindle 6 has an outside diameter of 20 mm. FIG. 5 also shows a torque ratio, that is, the ratio of the return torque "tr" to the forward torque.

As shown in FIG. 5, when the interval ln is approximately equal to the interval lo, a return torque "to" is equal to about a forward torque multiplied by 0.8. This relation agrees with that in a normal set of a bolt and a nut. In the case where the interval ln is equal to a value l1 appreciably greater than the value l0, the movable-side flange 3 starts to be rotated and reversed from the normal fastening position (corresponding to a return angle of 0 degree) by a return torque "tc" smaller than the previously-indicated return torque "to". As the movable-side flange 3 is reversed from the normal fastening position for a given angular range corresponding to the previously-indicated play, the fixed-side flange 5 slides on the engagement portion 7 of the spindle 6 and hence the return torque gradually decreases from the value "tc". When the movable-side flange 3 reaches the end of the given angular range, the walls of the fixed-side flange 5 which define the flat sides 8A and 8B of the groove 8 encounter edges of the flat surfaces 7A and 7B of the engagement portion 7 of the spindle 6. Accordingly, at this time, the return torque increases stepwise to a value t1 greater than the previously-indicated value "tc" but smaller than the previously-indicated value "t0". Then, the return torque gradually decreases from the value t1 as the return angle increases. As understood from the previous description, in the case where the interval ln is equal to the value l1, the maximum value of the return torque is equal to the value, t1.

In the case where the interval ln is equal to a value l2, greater than the value l1, the movable-side flange 3 starts to be rotated and reversed from the normal fastening position (corresponding to a return angle of 0 degree) by a return torque "tc" smaller than the previously-indicated return torque "to". As the movable-side flange 3 is reversed from the normal fastening position for a given angular range corresponding to the previously-indicated play, the fixed-side flange 5 slides on the engagement portion 7 of the spindle 6 and hence the return torque gradually decreases from the value "tc". When the movable-side flange 3 reaches the end of the given angular range, the walls of the fixed-side flange 5 which define the flat sides 8A and 8B of the groove 8 encounter edges of the flat surfaces 7A and 7B of the engagement portion 7 of the spindle 6. Accordingly, at this time, the return torque increases stepwise to a value t2 greater than the previously-indicated value "tc" but smaller than the previously-indicated value t1. Then, the return torque gradually decreases from the value t2 as the return angle increases. As understood from the previous description, in the case where the interval ln is equal to the value l2, the maximum value of the return torque is equal to the value t2.

Similarly, in the case where the interval ln is equal to a value l3 greater than the value l2, the maximum value of the return torque is equal to a value t3 greater than the previously-indicated value "tc" but smaller than the previously-indicated value t2. In the case where the interval ln is equal to a value l4 greater than the value l3, the maximum value of the return torque is equal to a value t4 greater than the previously-indicated value "tc" but smaller than the previously-indicated value t3.

It is preferable to provide lubricant solid material 11 between the contacting surfaces 9 and 10. The lubricant solid material means solid material having a certain lubricity. The lubricant solid material 11 may be fixed to either the contacting surface 9 or the contacting surface 10. As shown in FIG. 5, the presence of the lubricant solid material 11 reduces an initial return torque from the value "tc" to a value "tr". In this case, when the interval ln is equal to the value l1, the movable-side flange 3 starts to be rotated and reversed from the normal fastening position (corresponding to a return angle of 0 degree) by the return torque "tr" smaller than the previously-indicated return torque "tc". As the movable-side flange 3 is reversed from the normal fastening position for a given angular rage corresponding to the previously-indicated play, the fixed-side flange 5 slides on the engagement portion 7 of the spindle 6 and hence the return torque gradually decreases from the value "tr". When the movable-side flange 3 reaches the end of the given angular range, the walls of the fixed-side flange 5 which define the flat sides 8A and 8B of the groove 8 encounter edges of the flat surfaces 7A and 7B of the engagement portion 7 of the spindle 6. Accordingly, at this time, the return torque increases stepwise to a value t1 greater than the previously-indicated value "tr" but smaller than the previously-indicated value "to". Then, the return torque gradually decreases from the value t1 as the return angle increases.

As understood from the previous description, in the case where the lubricant solid material 11 is present and the interval ln is chosen to correspond to a given return angle θr, the return torque gradually decreases from the value "tr" as the movable-side flange 3 is reversed from the normal fastening position. The return torque increases stepwise to the value "tr" when the movable-side flange 3 reaches a position corresponding to the given return angle θr. Then, the return torque gradually decreases from the value "tr" again as the return angle increases. Thus, the return torque is limited to within a range equal to or below the value "tr".

The lubricant solid material 11 includes a TiC coating (a coating made of TiC), one of plastics of various types, teflon, silicone resin, nylon, or a molybdenum disulfide coating.

Second Embodiment

Figure 6:
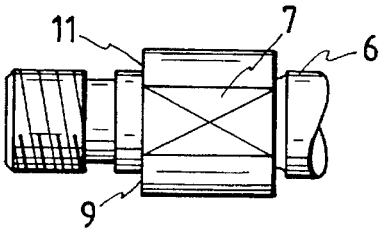
FIG. 6 is a sectional view of a spindle in an electric portable disk grinder according to a second embodiment of this invention.

FIG. 6 shows a second embodiment of this invention which is similar to the embodiment of FIGS. 1–5 except for design changes indicated hereinafter.

In the embodiment of FIG. 6, an end surface 9 of an engagement portion 7 of a spindle 6 is processed by sulfurizing and nitriding so that a lubricant solid layer 11 is formed on the end surface 9 of the engagement portion 7. The lubricant solid layer 11 is secured to the end surface 9 of the engagement portion 7. The lubricant solid layer 11 extends between the engagement portion 7 and a fixed-side flange 5 (see FIG. 2).

Third Embodiment

Figure 7:
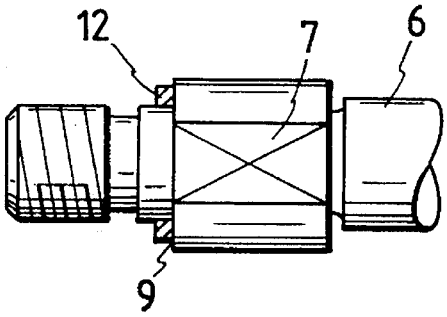
FIG. 7 is a sectional view of a spindle and a lubricant solid ring in an electric portable disk grinder according to a third embodiment of this invention.

FIG. 7 shows a third embodiment of this invention which is similar to the embodiment of FIGS. 1–5 except for design changes indicated hereinafter.

In the embodiment of FIG. 7, a lubricant solid ring 12 fits around a spindle 6. The lubricant solid ring 12 adjoins and contacts an end surface 9 of an engagement portion 7 of the spindle 6. The lubricant solid ring 12 extends between the engagement portion 7 and a fixed-side flange 5 (see FIG. 2). The lubricant solid ring 12 includes a steel processed by sulfurizing and nitriding, or a steel having a TiC coating. The lubricant solid ring 12 may be made of plastic such as polytetrafiuoroethylene resin. Mounting of the lubricant solid ring 12 on the spindle 6 is executed by a pressing process. Mounting of the lubricant solid ring 12 on the spindle 6 may be executed by another process such as a soldering process, a welding process, a calking process, or a bonding process using adhesive.

Fourth Embodiment

Figure 8:
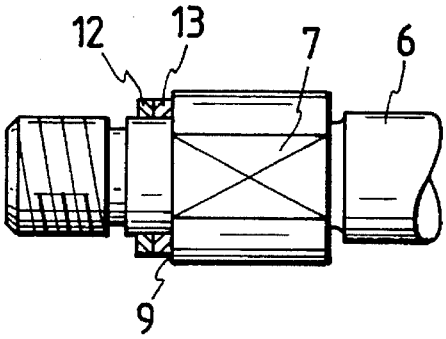
FIG. 8 is a sectional view of a spindle, a lubricant solid ring, and an abrasive-resistant ring in an electric portable disk grinder according to a fourth embodiment of this invention.

FIG. 8 shows a fourth embodiment of this invention which is similar to the embodiment of FIG. 7 except for design changes indicated hereinafter.

In the embodiment of FIG. 8, an abrasive-resistant ring 13 is fixed or provided around a spindle 6. The abrasive-resistant ring 13 adjoins and contacts an end surface 9 of an engagement portion 7 of the spindle 6. A lubricant solid ring 12 is provided around the spindle 6. The lubricant solid ring 12 adjoins and contacts an end surface of the abrasive-resistant ring 13. Thus, the abrasive-resistant ring 13 extends between the engagement portion 7 of the spindle 6 and the lubricant solid ring 12.

It should be noted that the abrasive-resistant ring 13 and the lubricant solid ring 12 may be exchanged in position.

Fifth Embodiment

Figure 9:
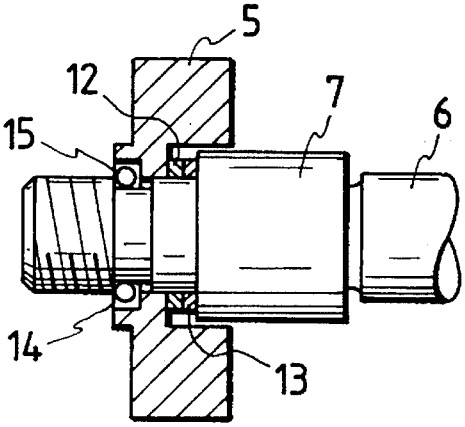
FIG. 9 is a sectional view of a spindle and a fixed-side flange in an electric portable disk grinder according to a fifth embodiment of this invention.

FIG. 9 shows a fifth embodiment of this invention which is similar to the embodiment of FIG. 8 except for design changes indicated hereinafter.

In the embodiment of FIG. 9, an end of a fixed-side flange 5 has a circular recess 14 for accommodating an O-ring 15. A spindle 6 has a circumferentially-extending groove into which the O-ring 15 fits. The O-ring 15 prevents separation of the fixed-side flange 5 from the spindle 6.

It should be noted that the 0-ring 15 may be replaced by an E-shaped ring or a C-shaped snap ring.

Sixth Embodiment

Figure 10:
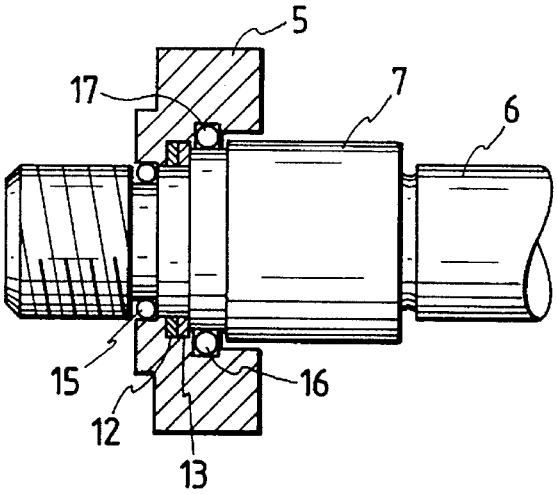
FIG. 10 is a sectional view of a spindle and a fixed-side flange in an electric portable disk grinder according to a sixth embodiment of this invention.

FIG. 10 shows a sixth embodiment of this invention which is similar to the embodiment of FIG. 9 except for design changes indicated hereinafter.

In the embodiment of FIG. 10, a fixed-side flange 5 has an inner circumferential groove 17 into which an O-ring 16 fits. The O-ring 16 extends between an outer circumferential surface of a spindle 6 and an inner circumferential surface of the fixed-side flange 5. The spindle 6 has a circumferentially-extending groove into which an O-ring 15 fits. The O-ring 15 extends between an outer circumferential surface of the spindle 6 and an inner circumferential surface of the fixed-side flange 5.

A lubricant solid ring 12 and an abrasive-resistant ring 13 extend in a central bore of the fixed-side flange 5. The lubricant solid ring 12 and the abrasive-resistant ring 13 are sandwiched between a shoulder on the spindle 6 and an inside step on the fixed-side flange 5. The lubricant solid ring 12 and the abrasive-resistant ring 13 are located in a region between the O-rings 15 and 16. The O-rings 15 and 16 cooperate to seal the lubricant solid ring 12 and the abrasive-resistant ring 13.

It should be noted that a groove for accommodating the O-ring 16 may be formed in the spindle 6.

The lubricant solid ring 12 may be replaced by a non-lubricant ring. In this case, lubricant such as grease is applied to surfaces of the non-lubricant ring 13.

Seventh Embodiment

Figure 11:
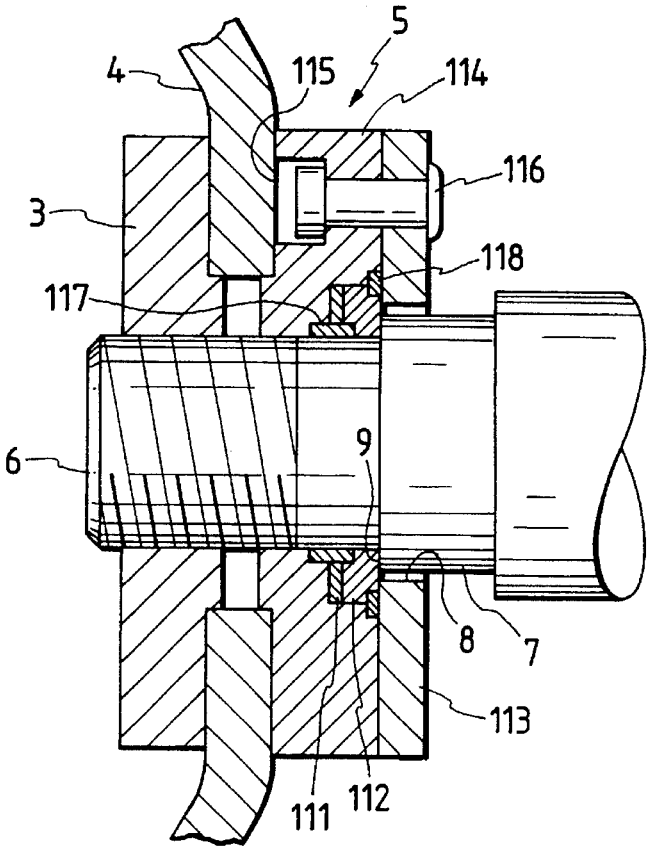
FIG. 11 is a sectional view of a main portion of an electric portable disk grinder according to a seventh embodiment of this invention.

FIG. 11 shows a seventh embodiment of this invention which is similar to the embodiment of FIGS. 1–5 except for design changes indicated hereinafter.

In the embodiment of FIG. 11, a fixed-side flange 5 has a main body 114 and an annular member 113 which are bonded together by rivets 116. The main body 114 has holes 115 accommodating the rivets 116.

The main body 114 of the fixed-side flange 5 has a central bore through which a spindle 6 extends. The central bore of the main body 114 accommodates a ring plate 111 and an annular backup plate 112 extending around the spindle 6. The ring plate 111 has a predetermined low coefficient of friction. The backup plate 112 is rotatable. The ring plate 111 extends between the backup plate 112 and an inside step on the main body 114. A fastening force transmitted from a movable-side flange 3 presses the fixed-side flange 5 against an engagement portion 7 of the spindle 6 via the backup plate 112.

The ring plate 111 is preferably made of polyimide or teflon. The ring plate 111 may include an oil-retaining metal.

Figure 12:
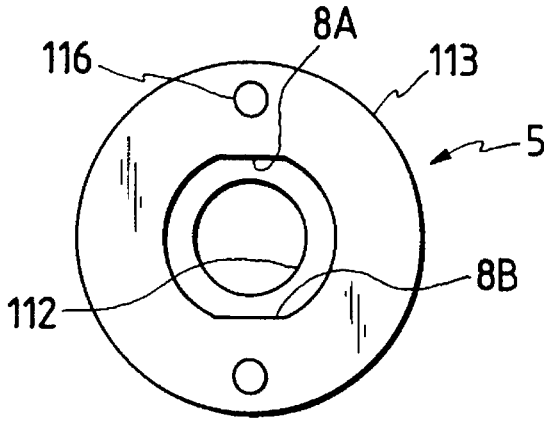
FIG. 12 is a plan view of a fixed-side flange in the portable disk grinder in FIG. 11.

As shown in FIGS. 11 and 12, the annular member 113 has a groove 8 into which an end of an engagement portion 7 of the spindle 6 extends. The annular member 113 engages the engagement portion 7 of the spindle 6. The groove 8 has a pair of parallel flat sides 8A and 8B, and arcuate sides extending between the flat sides 8A and 8B. The annular member 113 transmits a rotational force from the spindle 6 toward a grinding wheel 4 held between the fixed-side flange 5 and the movable-side flange 3. The annular member 113 defines an inside step or projection at an end of the bore in the main body 114. This inside step prevents separation of the ring plate 111 and the backup plate 112 from the freed-side flange 5 when the fixed-side flange 5 is detached from the spindle 6.

A sealing ring 117 fits in an annular space defined by walls of the spindle 6, the ring plate 111, the backup plate 112, and the main body 114. A sealing ring 118 fits in an annular space defined by walls of the annular member 113, the main body 114, and the backup plate 112. The sealing rings 117 and 118 cooperate to seal the ring plate 111. Separation of the sealing rings 117 and 118 from the fixed-side flange 5 is also prevented by the annular member 113.

The holes 115 in the main body 114 are exposed to portions of the grinding wheel 4. The presence of the holes 115 causes a greater friction between the fixed-side flange 5 and the grinding wheel 4.

The ring plate 111 may be made of plastic. In this case, to prevent a frictional contacting surface from extending outward of an opposite member, it is preferable to provide an escape portion along a periphery.

It is preferable that only deformed portions of the rivets 116 are set to a predetermined low hardness.

The ring plate 111 may be modified as follows. A modified ring plate 111 has an inner layer portion and an outer layer portion. The outer layer portion is made of, for example, polyimide. The inner layer portion includes, for example, an oil-retaining metal. An axial thickness of the outer layer portion is set slightly greater than an axial thickness of the inner layer portion. The outer layer portion is effective to receive a small load while the inner layer portion is operative to receive a great load.

Eighth Embodiment

Figure 13:
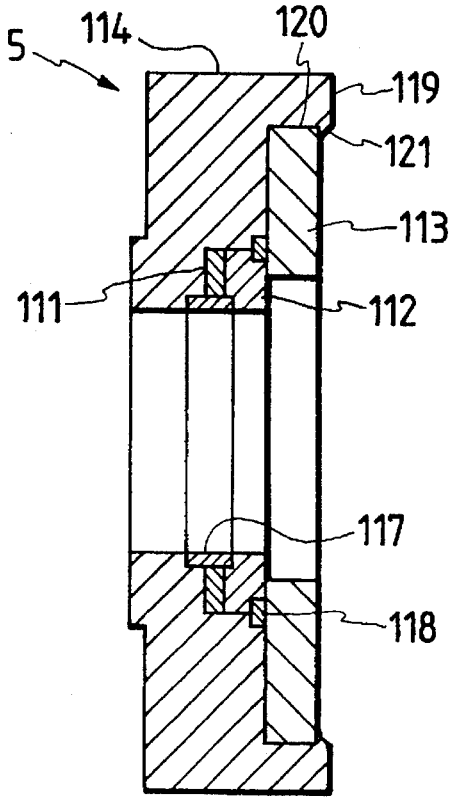
FIG. 13 is a sectional view of a fixed-side flange in an electric portable disk grinder according to an eighth embodiment of this invention.
Figure 14:
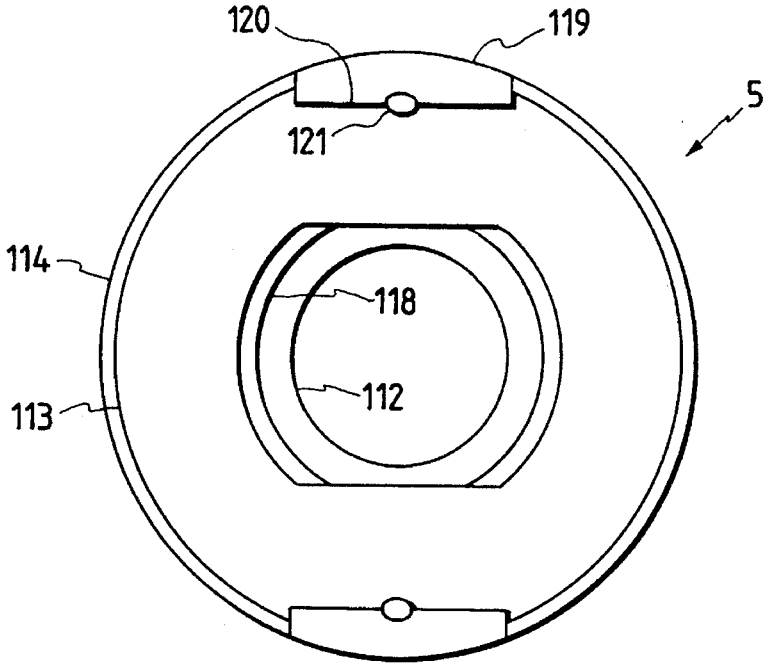
FIG. 14 is a plan view of the fixed-side flange in FIG. 13.

FIGS. 13 and 14 show an eighth embodiment of this invention which is similar to the embodiment of FIGS. 11 and 12 except for design changes indicated hereinafter.

In the embodiment of FIGS. 13 and 14, a main body 114 of a fixed-side flange 5 has a recess into an annular member 113 fits.

The main body 114 has inwardly-extending projections 119 which engage corresponding portions 120 of the annular member 113. Portions of edges of the inwardly-extending projections 119 are deformed to firmly hold the annular member 113 on the main body 114.

It should be noted that fixing the annular member 113 to the main body 114 may be executed by another process such as a soldering process, a welding process, or a bonding process using adhesive.

Ninth Embodiment

Figure 15:
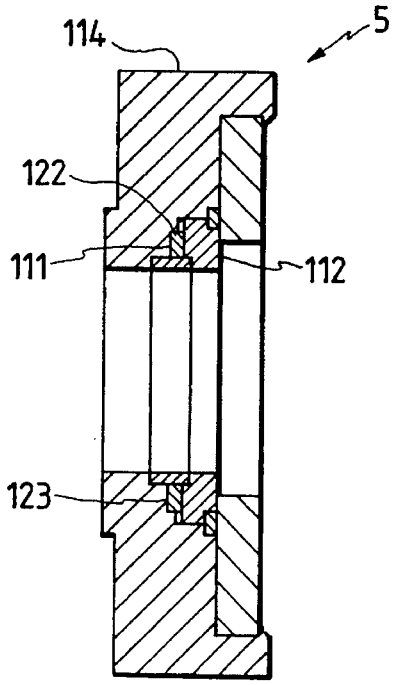
FIG. 15 is a sectional view of a fixed-side flange in an electric portable disk grinder according to a ninth embodiment of this invention.

FIG. 15 shows a ninth embodiment of this invention which is similar to the embodiment of FIGS. 13 and 14 except for design changes indicated hereinafter.

In the embodiment of FIG. 15, a main body 114 of a fixed-side flange 5 has a portion 123 abutting against an outer portion 122 of a ring plate 111. The portion 123 of the main body 114 is designed to prevent an increase in diameter of the ring plate 111 which would be caused by a load from a backup plate 112. During assembly, it is preferable to press the outer portion 122 of the ring plate 111 into engagement with the portion 123 of the main body 114.

A predetermined clearance or gap may be provided between the outer portion 122 of the ring plate 111 and the portion 123 of the main body 114. The clearance is designed to allow a given increase in diameter of the ring plate 111.

Tenth Embodiment

Figure 16:
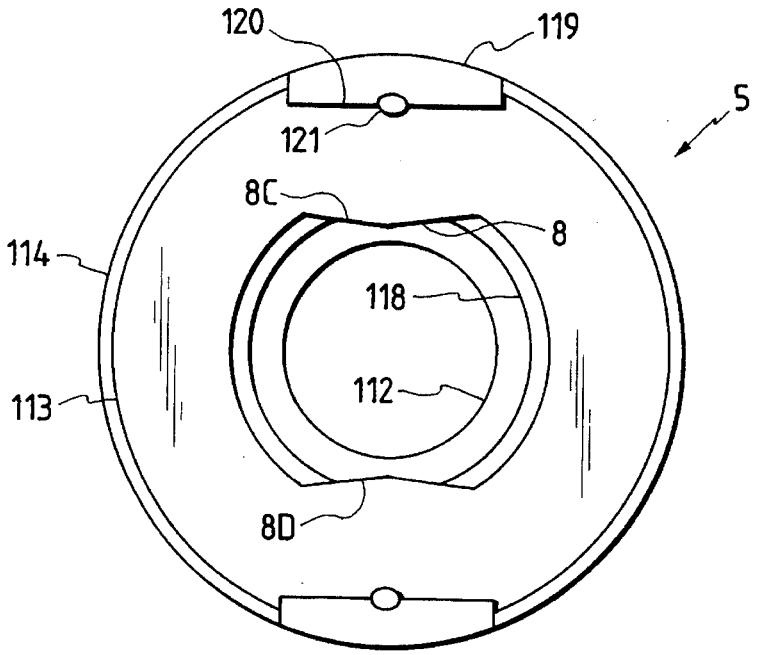
FIG. 16 is a plan view of a fumed-side flange in an electric portable disk grinder according to a tenth embodiment of this invention.

FIG. 16 shows a tenth embodiment of this invention which is similar to the embodiment of FIGS. 13 and 14 except for design changes indicated hereinafter.

In the embodiment of FIG. 16, an annular member 113 of a fixed-side flange 5 has a groove 8 into which an end of an engagement portion 7 of a spindle 6 (see FIG. 11) extends. The annular member 113 engages the engagement portion 7 of the spindle 6. The groove 8 has a pair of opposing sides 8C and 8D, and arcuate sides extending between the opposing sides 8C and 8D. Each of the opposing sides 8C and 8D is defined by a pair of flat walls of the annular member 113 which meet at a vertex having an angle smaller than 180 degrees. In other words, each of the opposing sides 8C and 8D is defined by a pair of flat planes oblique to each other at an angle smaller than 180 degrees. Thus, each of the opposing sides 8C and 8D has a bent configuration and forms an inward projection. This design provides an increased area of contact between the annular member 113 and the engagement portion 7 of the spindle 6.

Eleventh Embodiment

Figure 17:
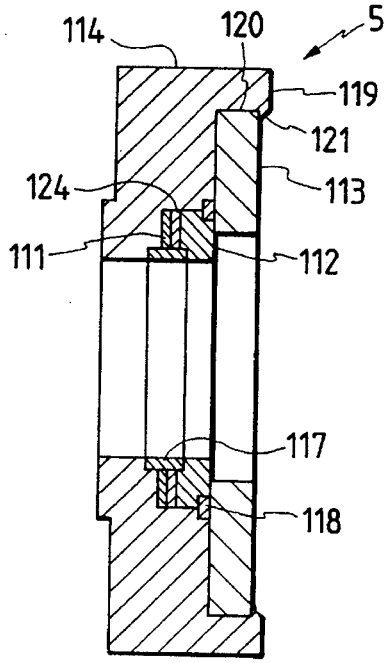
FIG. 17 is a sectional view of a fixed-side flange in an electric portable disk grinder according to an eleventh embodiment of this invention.

FIG. 17 shows an eleventh embodiment of this invention which is similar to the embodiment of FIGS. 13 and 14 except for design changes indicated hereinafter.

In the embodiment of FIG. 17, a slip ring 124 is provided between a ring plate 111 and a backup plate 112. It is preferable that the slip ring 124 has smooth surfaces.

Twelfth Embodiment

Figure 18:
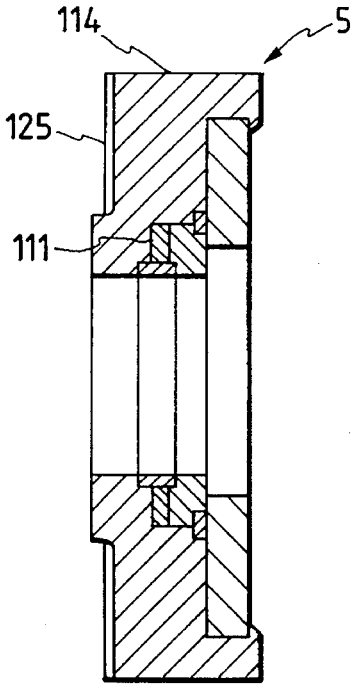
FIG. 18 is a sectional view of a fixed-side flange in an electric portable disk grinder according to a twelfth embodiment of this invention.
Figure 19:
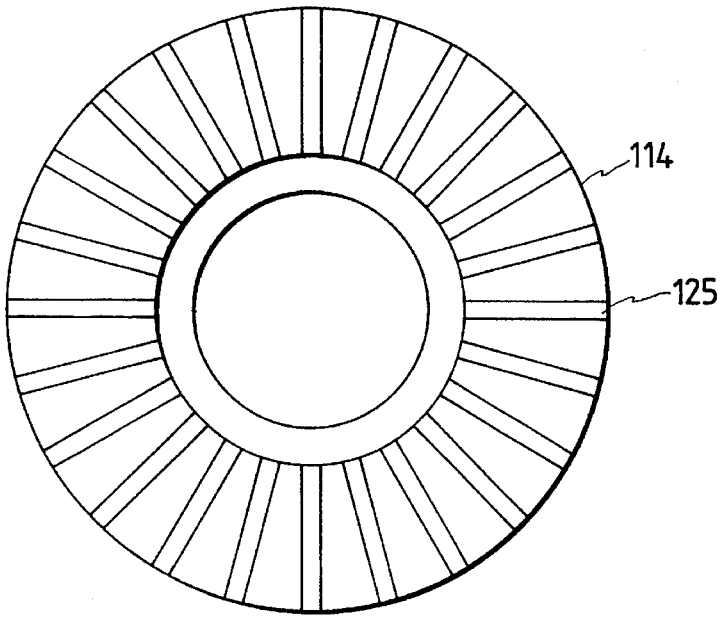
FIG. 19 is a side view of a main body of the fixed-side flange in FIG. 18.

FIGS. 18 and 19 show a twelfth embodiment of this invention which is similar to the embodiment of FIGS. 13 and 14 except for design changes indicated hereinafter.

In the embodiment of FIGS. 18 and 19, a fixed-side flange 5 has a main body 114, and an end surface of the main body 114 which contacts a grinding wheel 4 (see FIG. 11) is formed with radially-extending straight grooves 125. The presence of the grooves 125 provides an increased coefficient of friction between the main body 114 and the grinding wheel 4.

Thirteenth Embodiment

Figure 20:
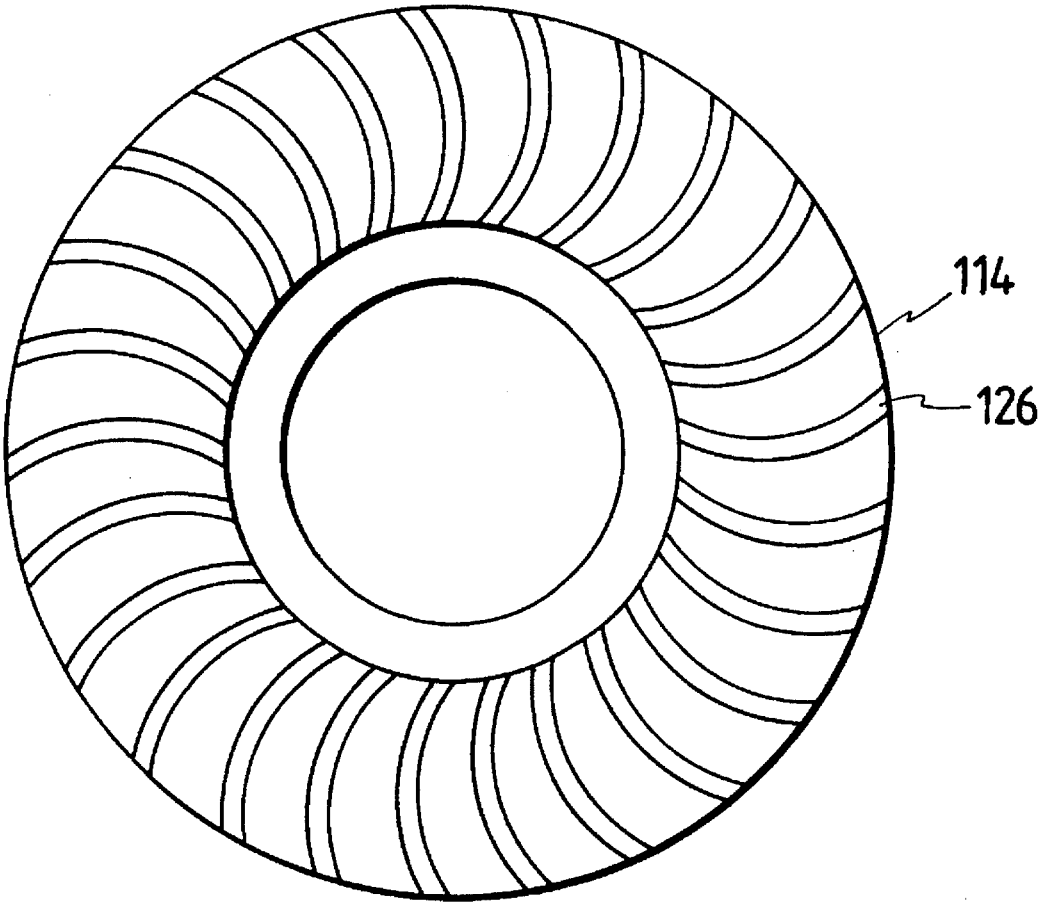
FIG. 20 is a side view of a main body of a fixed-side flange in an electric portable disk grinder according to a thirteenth embodiment of this invention.

FIG. 20 shows a thirteenth embodiment of this invention which is similar to the embodiment of FIGS. 18 and 19 except for design changes indicated hereinafter.

In the embodiment of FIG. 20, an end surface of a main body 114 which contacts a grinding wheel 4 (see FIG. 11) is formed with radially-extending curved grooves 126. The presence of the grooves 126 provides an increased coefficient of friction between the main body 114 and the grinding wheel 4.

What is claimed is:

1. A grinder having a grinding member, comprising:

a rotatable spindle having an engagement portion;

a first flange engaging the engagement portion of the spindle, wherein the first flange and the engagement portion of the spindle define a given play therebetween in a direction of rotation;

a second flange;

means for enabling the grinding member to be held between the first flange and the second flange; and a ring member including a lubricant solid material provided between the first flange and the engagement portion of the spindle.

2. The grinder of claim 1, wherein the ring member comprises a first and second piece, the first piece including a lubricant solid member, the second piece including an abrasive-resistant member.

3. The grinder of claim 1, further comprising means for preventing separation of the first flange from the spindle.

4. The grinder of claim 1, further comprising means for sealing the ring member.

5. The grinder of claim 1, wherein the ring member comprises a non-lubricant ring member and a lubricant applied to the ring member.

6. A grinder having a grinding member, comprising:

a rotatable spindle having an engagement portion;

a first flange engaging the engagement portion of the spindle,through a plastic ring play, wherein the first flange and the engagement portion of the spindle define a given play therebetween in a direction of rotation;

a second flange; and means for enabling the grinding member to be held between the first flange and the second flange;

wherein the first flange comprises a main body, a sub member, and means for bonding the sub member and the main body together, the sub member engaging the engagement portion of the spindle.

7. The grinder of claim 6, further comprising means, provided on a surface of the first flange which contacts the grinding member, for increasing a coefficient of friction between the first flange and the grinding member.

8. The grinder of claim 7, wherein the increasing means comprises a recess in the surface of the first flange, and the bonding means comprises a rivet at least partially disposed in the recess.

9. The grinder of claim 6, wherein the bonding means comprises a projection on the main body, a corresponding portion of the sub member which engages the projection, and means for connecting a part of the projection to the sub member.

10. The grinder of claim 6, wherein the sub member has a bent surface for engaging the engagement portion of the spindle.

11. The grinder of claim 6, wherein a portion of the main body limits a deformation of an outer part of the ring member to suppress an increase in an outside diameter of the ring member.

* * * * *